US011661911B2

(12) United States Patent
Nakagawa et al.

(10) Patent No.: US 11,661,911 B2
(45) Date of Patent: May 30, 2023

(54) EVAPORATED FUEL TREATMENT DEVICE

(71) Applicant: FUTABA INDUSTRIAL CO., LTD., Okazaki (JP)

(72) Inventors: Takuya Nakagawa, Okazaki (JP); Masahito Hosoi, Okazaki (JP); Tamami Ina, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 0 days.

(21) Appl. No.: 17/578,725

(22) Filed: Jan. 19, 2022

(65) Prior Publication Data

US 2022/0252025 A1 Aug. 11, 2022

(30) Foreign Application Priority Data

Feb. 5, 2021 (JP) ..... JP2021-017416

(51) Int. Cl.
*F02M 25/08* (2006.01)

(52) U.S. Cl.
CPC .... *F02M 25/0854* (2013.01); *F02M 25/0872* (2013.01)

(58) Field of Classification Search
CPC ..... F02M 25/0854; F02M 25/0872
See application file for complete search history.

(56) References Cited

U.S. PATENT DOCUMENTS 5,337,721 A 8/1994 Kasuya et al.
2013/0186375 A1* 7/2013 Hasegawa ..... F02M 25/06 123/519
2013/0263740 A1* 10/2013 Mani ..... B01D 53/0407 96/112

FOREIGN PATENT DOCUMENTS

JP H0515722 A 1/1993
JP H0674108 A 3/1994
JP H06307300 A 11/1994
JP 2015057551 A 3/2015

OTHER PUBLICATIONS

Notice of Reasons for Refusal for Japanese Patent Application No. 2021017416, dated Nov. 15, 2022, 6 pages.

* cited by examiner

*Primary Examiner* — Xiao En Mo

(74) *Attorney, Agent, or Firm* — Withrow & Terranova, P.L.L.C.; Vincent K. Gustafson

(57) ABSTRACT

Provided is an evaporated fuel treatment device configured to adsorb and desorb an evaporated fuel originating in a fuel tank. A first adsorption chamber is arranged in a flow passage. A second adsorption chamber is connected to the first adsorption chamber, and is arranged, in the flow passage, closer to an atmosphere port with respect to the first adsorption chamber. A first adsorption layer is arranged within the first adsorption chamber, and adsorbs the evaporated fuel. A second adsorption layer is arranged within the second adsorption chamber, and adsorbs the evaporated fuel. A sectional area of the second adsorption layer perpendicular to a direction in which the evaporated fuel flows through the second adsorption layer being larger than a sectional area of the first adsorption layer perpendicular to a direction in which the evaporated fuel flows through the first adsorption layer.

6 Claims, 5 Drawing Sheets

EVAPORATED FUEL TREATMENT DEVICE

CROSS-REFERENCE TO RELATED APPLICATIONS

This application claims the benefit of Japanese Patent Application No. 2021-17416 filed on Feb. 5, 2021 with the Japan Patent Office, the entire disclosure of which is incorporated herein by reference.

BACKGROUND

The present disclosure relates to an evaporated fuel treatment device.

Vehicles such as automobiles are each equipped with an evaporated fuel treatment device that inhibits an evaporated fuel originating in a fuel tank from being released into the atmosphere. The evaporated fuel treatment device comprises a charge port configured to take in the evaporated fuel, a purge port configured to discharge the evaporated fuel, an atmosphere port open to the atmosphere, and adsorption chambers forming a flow passage through which the evaporated fuel passes. The charge port and the purge port are arranged at an end of the flow passage through which the evaporated fuel passes. The atmosphere port is arranged at an end opposite to the end where the charge port and the purge port are arranged of the flow passage through which the evaporated fuel passes. Arranged within each adsorption chamber is an adsorption layer for adsorbing the evaporated fuel. The evaporated fuel treatment device accumulates the evaporated fuel taken in through the charge port, and discharges the accumulated evaporated fuel to an internal combustion engine through the purge port by means of air taken in through the atmosphere port.

As an evaporated fuel treatment device of this kind, Japanese Unexamined Patent Application Publication No. 2015-057551 discloses a device in which a passage cross-sectional area of the adsorption chamber on the side of the atmosphere port is smaller than a passage cross-sectional area of the adjacent adsorption chamber.

SUMMARY

In the case where the passage cross-sectional area of the adsorption chamber on the side of the atmosphere port is smaller than the passage cross-sectional area of the adjacent adsorption chamber, the flow passage in the adsorption chamber on the side of the atmosphere port is narrower, resulting in tendency of increased ventilation resistance at the time of inflow of the evaporated fuel.

It is desirable that one aspect of the present disclosure provide an evaporated fuel treatment device with reduced ventilation resistance.

One aspect of the present disclosure is an evaporated fuel treatment device configured to adsorb and desorb an evaporated fuel originating in a fuel tank. The evaporated fuel treatment device comprises a charge port, a purge port, an atmosphere port, a first adsorption chamber, a second adsorption chamber, a first adsorption layer, and a second adsorption layer. The charge port and the purge port are arranged at an end of a flow passage through which the evaporated fuel passes. The charge port is configured to take in the evaporated fuel. The purge port is configured to discharge the evaporated fuel. The atmosphere port is arranged at an end opposite to the end where the charge port and the purge port are arranged of the flow passage, and is open to the atmosphere. The first adsorption chamber is arranged in the flow passage. The second adsorption chamber is connected to the first adsorption chamber, and is arranged, in the flow passage, closer to the atmosphere port with respect to the first adsorption chamber. The first adsorption layer is arranged within the first adsorption chamber, and adsorbs the evaporated fuel. The second adsorption layer is arranged within the second adsorption chamber, and adsorbs the evaporated fuel. A sectional area of the second adsorption layer perpendicular to a direction in which the evaporated fuel flows through the second adsorption layer is larger than a sectional area of the first adsorption layer perpendicular to a direction in which the evaporated fuel flows through the first adsorption layer.

Such a configuration allows for reduction of a ventilation resistance in the evaporated fuel treatment device.

In one aspect of the present disclosure, the direction in which the evaporated fuel flows through the second adsorption layer may intersect with the direction in which the evaporated fuel flows through the first adsorption layer. Such a configuration enables reduction of a protrusion width of the second adsorption chamber.

In one aspect of the present disclosure, the second adsorption chamber may include therein a space arranged between the first adsorption layer and the second adsorption layer in the flow passage. Such a configuration enables delay in release of the evaporated fuel toward the atmosphere.

In one aspect of the present disclosure, the space may be located on a lower side within the second adsorption chamber in a state where the evaporated fuel treatment device is mounted in a vehicle. Such a configuration enables more delay in the release of the evaporated fuel toward the atmosphere.

BRIEF DESCRIPTION OF THE DRAWINGS

Example embodiments of the present disclosure will be described below with reference to the accompanying drawings, in which.

DETAILED DESCRIPTION OF EXEMPLARY EMBODIMENTS

1. First Embodiment

[1-1. Configuration]

Figure 1:
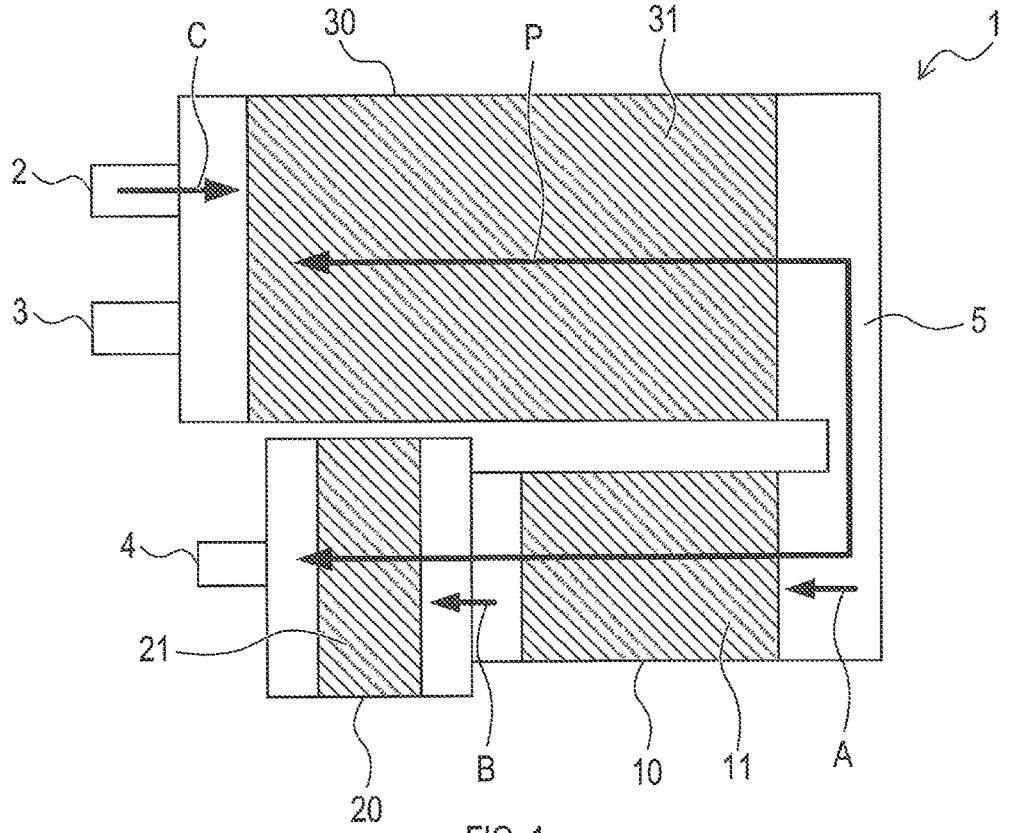
FIG. 1 is a schematic sectional view of an evaporated fuel treatment device according to a first embodiment.

An evaporated fuel treatment device 1 shown in FIG. 1 is a device to adsorb and desorb an evaporated fuel originating in a fuel tank.

The evaporated fuel treatment device 1 comprises a charge port 2, a purge port 3, an atmosphere port 4, adsorption chambers 10, 20, and 30, and a connecting passage 5.

The charge port 2 is connected to the fuel tank of a vehicle via a piping. The charge port 2 is configured to introduce the evaporated fuel originating in the fuel tank into the evaporated fuel treatment device 1.

The purge port 3 is connected to an intake pipe of an internal combustion engine via a purge valve (not shown). The purge port 3 is configured to discharge the evaporated fuel to supply it to the internal combustion engine.

The atmosphere port 4 is open to the atmosphere. The atmosphere port 4 is configured to atmospherically release air from which the evaporated fuel has been removed. Further, the atmosphere port 4 is configured to take in air to thereby desorb the evaporated fuel adsorbed within the evaporated fuel treatment device 1.

The charge port 2 and the purge port 3 are arranged at an end of a flow passage P through which the evaporated fuel passes within the evaporated fuel treatment device 1. The atmosphere port 4 is arranged at an end opposite to the end where the charge port 2 and the purge port 3 are arranged of the flow passage P.

The evaporated fuel treatment device 1 comprises a first adsorption chamber 10, a second adsorption chamber 20, and a third adsorption chamber 30. These adsorption chambers are arranged in the order of the second adsorption chamber 20, the first adsorption chamber 10, and the third adsorption chamber 30 sequentially along the flow passage P from the side where the atmosphere port 4 is arranged. The second adsorption chamber 20 is provided with the above-described atmosphere port 4. The third adsorption chamber 30 is provided with the above-described charge port 2 and purge port 3.

The first adsorption chamber 10 and the third adsorption chamber 30 are connected to each other via the connecting passage 5. When the evaporated fuel flows in from the fuel tank, the evaporated fuel that has flowed into the third adsorption chamber 30 changes the directions along the connecting passage 5, thus flowing into the first adsorption chamber 10 so as to move in a direction opposite to an inflow direction C of the evaporated fuel flowing into the third adsorption chamber 30. The first adsorption chamber 10 and the second adsorption chamber 20 are arranged serially along an inflow direction A of the evaporated fuel flowing into the first adsorption chamber 10. An inflow direction B of the evaporated fuel flowing into the second adsorption chamber 20 is along the inflow direction A of the evaporated fuel flowing into the first adsorption chamber 10. Accordingly, the flow passage P formed by the first adsorption chamber 10, the second adsorption chamber 20, the third adsorption chamber 30, and the connecting passage 5 is substantially U-shaped.

The third adsorption chamber 30 is a main chamber having the largest volume of the three adsorption chambers. Arranged within the third adsorption chamber 30 is a third adsorption layer 31 that adsorbs the evaporated fuel. The third adsorption layer 31 is formed of an adsorbent packed. Examples of the adsorbent may include activated carbon. Examples of the activated carbon may include granular activated carbon, those formed into a honeycomb shape, and those formed with fibrous activated carbon into a sheet shape, a rectangular parallelepiped shape, a cylindroid shape, a polygonal columnar shape, or another shape.

The first adsorption chamber 10 and the second adsorption chamber 20 are each an auxiliary chamber having a smaller volume than the third adsorption chamber 30 as the main chamber.

Arranged within the first adsorption chamber 10 is a first adsorption layer 11 that adsorbs the evaporated fuel. Arranged within the second adsorption chamber 20 is a second adsorption layer 21 that adsorbs the evaporated fuel. The first adsorption layer 11 and the second adsorption layer 21 are each formed of an adsorbent packed. Examples of the adsorbent may be similar to those listed as the adsorbent for the third adsorption layer 31.

Figure 3:
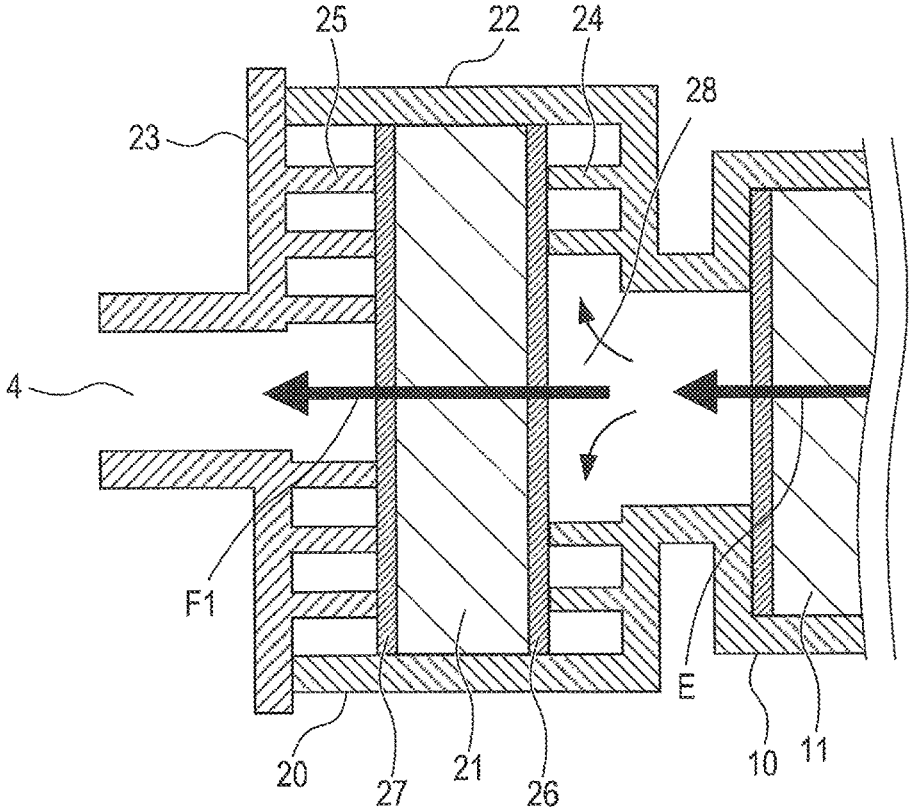
FIG. 3 is a schematic sectional view of a second adsorption chamber and therearound in the evaporated fuel treatment device according to the first embodiment.

As shown in FIG. 3, the second adsorption chamber 20 comprises the above-described second adsorption layer 21, a case 22, a lid 23, a case-side support 24, a lid-side support 25, and partition members 26 and 27.

The case 22 is an outer frame forming the second adsorption chamber 20. The case 22 is one piece with an outer frame forming the first adsorption chamber 10. The lid 23 is configured to close an opening of the case 22. The case 22 and the lid 23 are welded together.

The case-side support 24 is provided to stand upright from a bottom surface of the second adsorption chamber 20 if the side where the atmosphere port 4 is arranged is viewed as an upper side, and supports the second adsorption layer 21 via a partition member 26. The partition member 26 is configured with a filter, a grid, or the like. The grid is a plate-shaped member containing holes (not shown) that serve as passages for the evaporated fuel.

The lid-side support 25 is provided to stand upright from the lid 23, and supports the second adsorption layer 21 via a partition member 27. The partition member 27 has a configuration similar to that of the partition member 26.

The second adsorption chamber 20 includes therein a space 28 arranged between the first adsorption layer 11 and the second adsorption layer 21 in the flow passage P.

Figure 2:
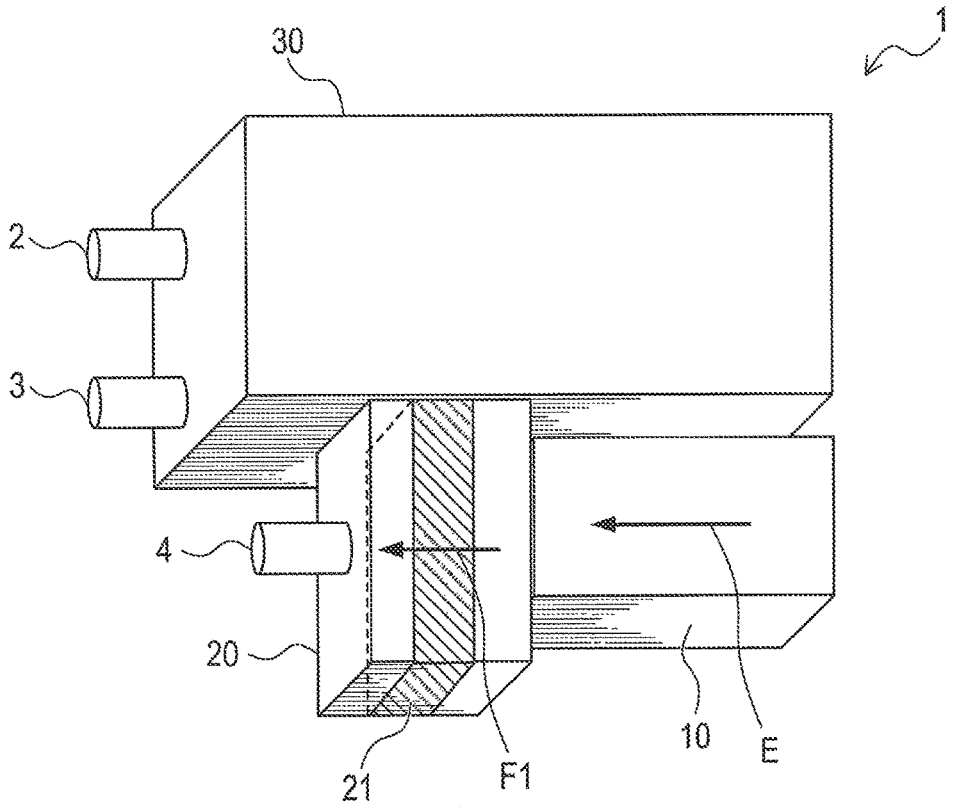
FIG. 2 is a schematic perspective view of the evaporated fuel treatment device according to the first embodiment.

As shown in FIG. 2, the second adsorption layer 21 is arranged in the second adsorption chamber 20 such that the largest surface of the second adsorption layer 21 having a rectangular parallelepiped shape intersects with a flow direction E, specifically, substantially perpendicularly. The flow direction E is a direction in which the evaporated fuel flows through the first adsorption layer 11. As shown in FIG. 3, a flow direction F1 in which the evaporated fuel flows through the second adsorption layer 21 is along the flow direction E. A sectional area of the second adsorption layer 21 perpendicular to the flow direction F1 is larger than a sectional area of the first adsorption layer 11 perpendicular to the flow direction E.

"Substantially perpendicularly" as used herein implies "not necessarily at right angles". For example, the largest surface of the second adsorption layer 21 having the rectangular parallelepiped shape may be inclined at an angle of 5° or less with respect to a plane perpendicular to the flow direction E. The same applies hereafter.

In the second adsorption layer 21, L/D, which is a ratio of a length L [mm] of the flow direction F1 to an equivalent diameter D [mm] in a section perpendicular to the flow direction F1, is preferably 0.6 or less. The "equivalent diameter D in a section perpendicular to the flow direction F1" means an average value, along the flow direction F1, of a diameter ($D=(S/\pi)^{1/2}\times 2$) of a perfect circle having the same area as a section S perpendicular to the flow direction F1 in the second adsorption layer 21. If the L/D is 0.6 or less, when air is taken in through the atmosphere port 4 to thereby desorb the evaporated fuel, the evaporated fuel adsorbed in the second adsorption chamber 20 flows completely toward the first adsorption chamber 10 in a short time. Thus, an amount of the evaporated fuel remaining within the second adsorption chamber 20 can be reduced.

[1-2. Effects]

The first embodiment as detailed above produces effects below.

(1a) Since the sectional area of the second adsorption layer 21 perpendicular to the flow direction F1 is larger than the sectional area of the first adsorption layer 11 perpendicular to the flow direction E, a ventilation resistance of the evaporated fuel passing through the second adsorption layer 21 is reduced. Thus, a ventilation resistance in the entirety of the evaporated fuel treatment device 1 is reduced.

Further, since the evaporated fuel proceeding from the first adsorption layer 11 toward the second adsorption layer 21 diffuses so as to spread as shown in FIG. 3, it is possible to reduce the ventilation resistance in the evaporated fuel treatment device 1 while delaying release of the evaporated fuel toward the atmosphere. Such delay in the release of the evaporated fuel toward the atmosphere enables reduction of the evaporated fuel generated due to changes in outside temperature during long-term parking (i.e., reduction of diurnal breathing loss), even if the length along the flow direction F1 is shorter.

(1b) The second adsorption chamber 20 includes therein the space 28 arranged between the first adsorption layer 11 and the second adsorption layer 21 in the flow passage P. This allows the evaporated fuel that has flowed into the second adsorption chamber 20 along the flow direction E to diffuse so as to spread perpendicularly to the flow direction E in the space 28. Thus, the release of the evaporated fuel toward the atmosphere can be delayed as compared with a case where the space 28 is not arranged between the first adsorption layer 11 and the second adsorption layer 21. Especially, if the space 28 is located on a lower side within the second adsorption chamber 20 in a state where the evaporated fuel treatment device 1 is mounted in the vehicle, the evaporated fuel is more prone to stay within the space 28, thus allowing for more delay in the release of the evaporated fuel toward the atmosphere.

2. Second Embodiment

[1-1. Configuration]

Since a basic configuration of a second embodiment is similar to that of the first embodiment, differences therebetween will be described below. The same reference numerals as those in the first embodiment indicate similar elements, and the preceding descriptions are to be referred to.

Figure 4:
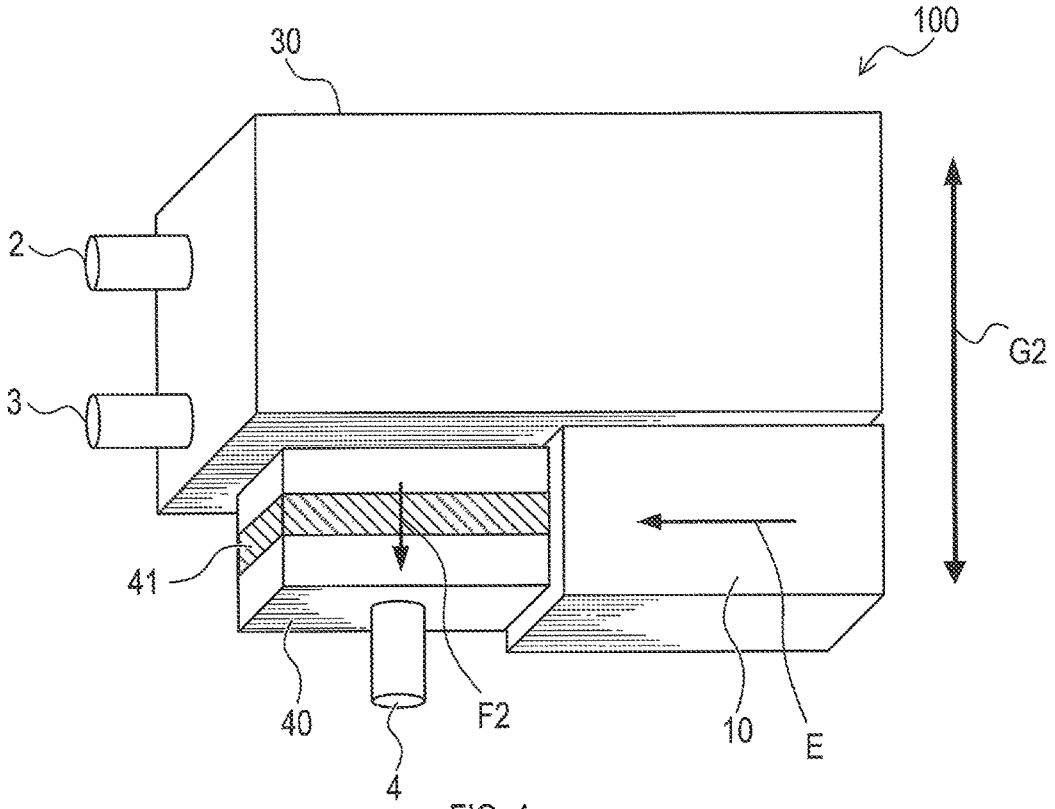
FIG. 4 is a schematic perspective view of an evaporated fuel treatment device according to a second embodiment.

An evaporated fuel treatment device 100 shown in FIG. 4 differs from the evaporated fuel treatment device 1 of the first embodiment in terms of flow of the evaporated fuel within a second adsorption chamber 40.

A second adsorption layer 41 is arranged in the second adsorption chamber 40 such that the largest surface of the second adsorption layer 41 having a rectangular parallelepiped shape intersects with an alignment direction G2, specifically, substantially perpendicularly. The alignment direction G2 is a direction in which the third adsorption chamber 30 is aligned with the first adsorption chamber 10 and the second adsorption chamber 40. A flow direction F2 in which the evaporated fuel flows through the second adsorption layer 41 intersects with the flow direction E, specifically, substantially perpendicularly, and concurrently is along the alignment direction G2. Similarly to the first embodiment, a sectional area of the second adsorption layer 41 perpendicular to the flow direction F2 is larger than the sectional area of the first adsorption layer 11 perpendicular to the flow direction E.

Figure 5:
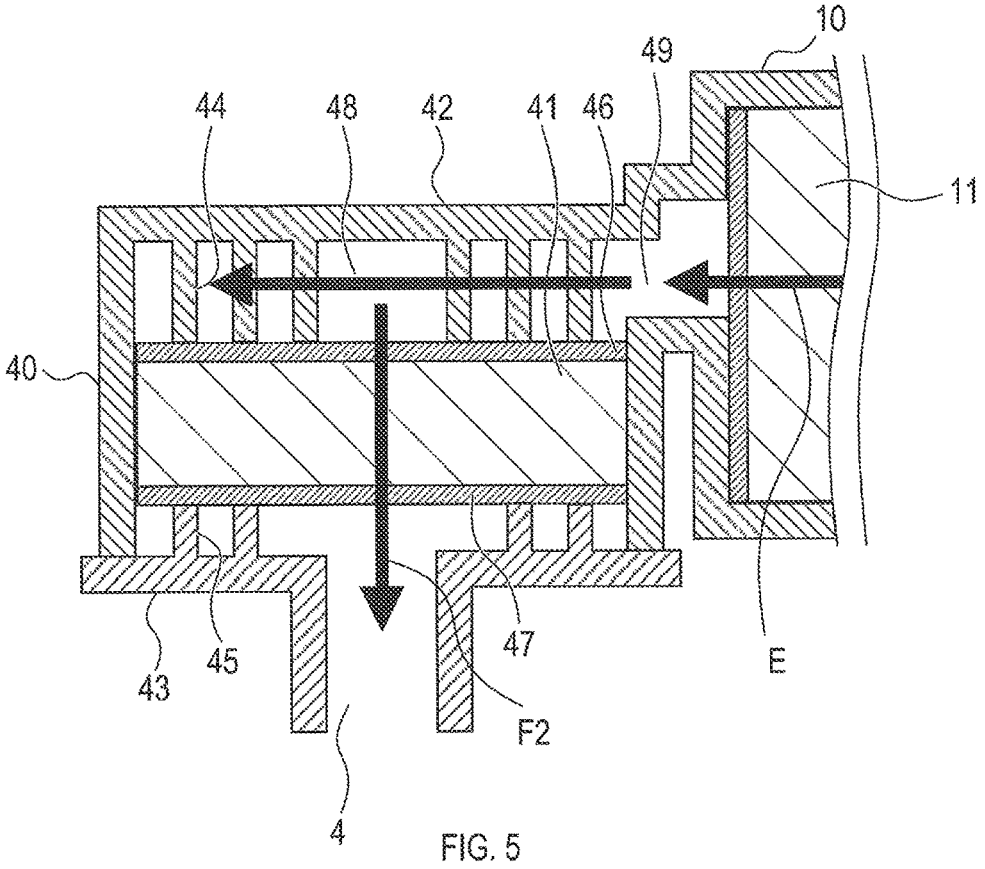
FIG. 5 is a schematic sectional view of a second adsorption chamber and therearound in the evaporated fuel treatment device according to the second embodiment.

As shown in FIG. 5, the second adsorption chamber 40 comprises the second adsorption layer 41, a case 42, a lid 43, a case-side support 44, a lid-side support 45, and partition members 46 and 47.

The case 42 is an outer frame forming the second adsorption chamber 40. The case 42 is one piece with the outer frame forming the first adsorption chamber 10. The lid 43 is configured to close an opening of the case 42. The case 42 and the lid 43 are welded together.

The case-side support 44 is provided to stand upright from a surface closer to the third adsorption chamber 30 in the second adsorption chamber 40, and supports the second adsorption layer 41 via the partition member 46. The partition member 46 has a configuration similar to that of the partition members 26 and 27 in the first embodiment.

The lid-side support 45 is provided to stand upright from the lid 43, and supports the second adsorption layer 41 via the partition member 47. The partition member 47 has a configuration similar to that of the partition members 26 and 27 in the first embodiment.

The second adsorption chamber 40 includes therein a space 48 arranged between the first adsorption layer 11 and the second adsorption layer 41 in the flow passage. A sectional area of the space 48 adjacent to a connection opening 49 open to the first adsorption chamber 10 is larger than an opening area of the connection opening 49. The second adsorption layer 41 is arranged in a position not overlapping the connection opening 49 in the second adsorption chamber 40.

[2-1. Effects]

The second embodiment as detailed above produces effects below in addition to the effect (1a) of the first embodiment.

The second adsorption chamber 40 includes therein the space 48 arranged between the first adsorption layer 11 and the second adsorption layer 41 in the flow passage. This allows the evaporated fuel to diffuse so as to spread deeper in the space 48 along a direction flowing into the second adsorption chamber 40, thus making it possible to reduce the ventilation resistance in the evaporated fuel treatment device 100 while delaying release of the evaporated fuel toward the atmosphere, as compared with a case where the space 48 is not arranged between the first adsorption layer 11 and the second adsorption layer 41. Especially, if the space 48 is located on a lower side within the second adsorption chamber 40 in a state where the evaporated fuel treatment device 100 is mounted in the vehicle, the evaporated fuel is more prone to stay within the space 48, thus allowing for more delay in the release of the evaporated fuel toward the atmosphere.

3. Third Embodiment

[3-1. Configuration]

Since a basic configuration of a third embodiment is similar to that of the first embodiment, differences therebetween will be described below. The same reference numerals as those in the first embodiment indicate similar elements, and the preceding descriptions are to be referred to.

Figure 6:
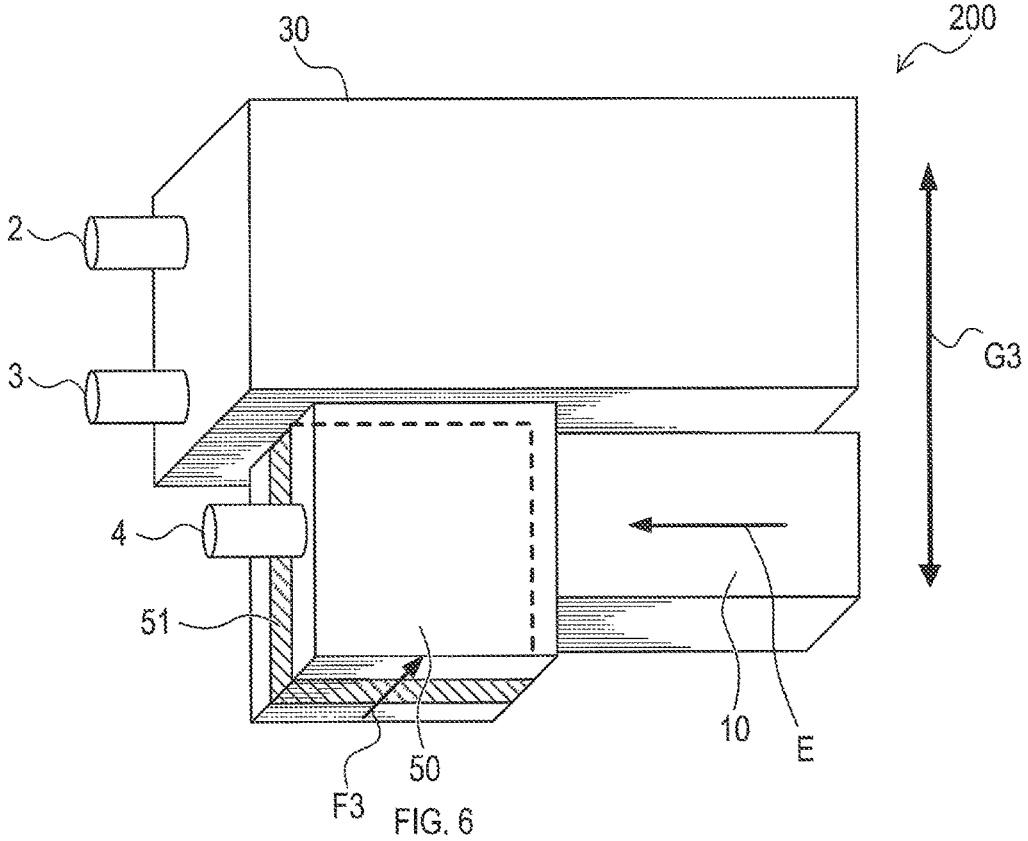
FIG. 6 is a schematic perspective view of an evaporated fuel treatment device according to a third embodiment.

An evaporated fuel treatment device 200 shown in FIG. 6 differs from the evaporated fuel treatment device 1 of the first embodiment and from the evaporated fuel treatment device 100 of the second embodiment in terms of flow of the evaporated fuel within a second adsorption chamber 50.

A second adsorption layer 51 is arranged in the second adsorption chamber 50 such that the largest surface of the second adsorption layer 51 having a rectangular parallelepiped shape is along the flow direction E and along an alignment direction G3, specifically, so as to be substantially parallel to each other. The alignment direction G3 is a direction in which the third adsorption chamber 30 is aligned with the first adsorption chamber 10 and the second adsorption chamber 50. A flow direction F3 in which the evaporated fuel flows through the second adsorption layer 51 intersects with the flow direction E, specifically, substantially perpendicularly, and concurrently intersects with the alignment direction G3, specifically, substantially perpendicularly. Similarly to the first and second embodiments, a sectional area of the second adsorption layer 51 perpendicular to the flow direction F3 is larger than the sectional area of the first adsorption layer 11 perpendicular to the flow direction E.

[3-2. Effects]

The third embodiment as detailed above produces effects similar to the effect (1a) of the first embodiment and to the effects of the second embodiment.

As illustrated in the above-described first to third embodiments, the sectional area of the second adsorption layer perpendicular to the direction in which the evaporated fuel flows through the second adsorption layer is larger than the sectional area of the first adsorption layer perpendicular to the direction in which the evaporated fuel flows through the first adsorption layer. Such a configuration makes it easier to accommodate various layouts different in an orientation in which the atmosphere port extends. If the sectional area of the second adsorption layer perpendicular to the direction in which the evaporated fuel flows through the second adsorption layer is smaller than the sectional area of the first adsorption layer perpendicular to the direction in which the evaporated fuel flows through the first adsorption layer, the second adsorption layer needs to have a relatively long length in the direction in which the evaporated fuel flows through the second adsorption layer in order to secure a desired amount of adsorption. This results in considerable protrusion of the second adsorption chamber if the orientation in which the atmosphere port extends from the second adsorption chamber is to be changed from the orientation illustrated in the first embodiment to, for example, the orientation illustrated in the second embodiment or in the third embodiment. By contrast, the configuration in which the sectional area of the second adsorption layer perpendicular to the direction in which the evaporated fuel flows through the second adsorption layer is larger than the sectional area of the first adsorption layer perpendicular to the direction in which the evaporated fuel flows through the first adsorption layer makes it possible to reduce a protrusion width of the second adsorption chamber. Thus, the evaporated fuel treatment device can be made more compact in various piping layouts different in the orientation in which the atmosphere port extends. Moreover, making the evaporated fuel treatment device more compact enables arrangement of peripheral components associated with the evaporated fuel treatment device, such as a component for leak check or a valve, in a saved space.

4. Fourth Embodiment

Since a basic configuration of a fourth embodiment is similar to that of the second embodiment, differences therebetween will be described below. The same reference numerals as those in the first embodiment indicate similar elements, and the preceding descriptions are to be referred to.

Figure 7:
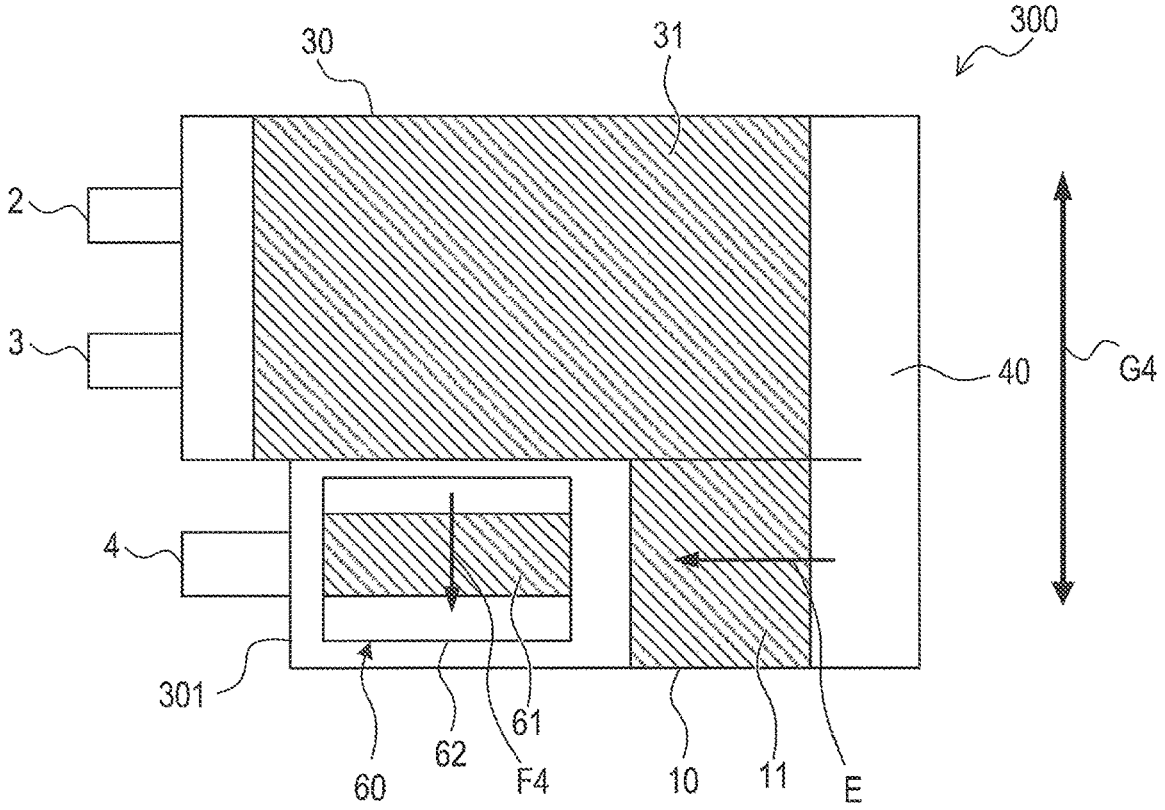
FIG. 7 is a schematic sectional view of an evaporated fuel treatment device according to a fourth embodiment.

In an evaporated fuel treatment device 300 shown in FIG. 7, an inner case 62 forming a second adsorption chamber 60 is mounted inside an outer case 301 forming a part of an outer frame of the evaporated fuel treatment device 300.

As shown in FIG. 7, similarly to the second embodiment, the second adsorption layer 61 is arranged in the second adsorption chamber 60 such that the largest surface of the second adsorption layer 61 having a rectangular parallelepiped shape intersects with an alignment direction G4, specifically, substantially perpendicularly. The alignment direction G4 is a direction in which the third adsorption chamber 30 is aligned with the first adsorption chamber 10 and the second adsorption chamber 60. A flow direction F4 in which the evaporated fuel flows through the second adsorption layer 61 intersects with the flow direction E, specifically, substantially perpendicularly, and concurrently is along the alignment direction G4. Similarly to the first to third embodiments, a sectional area of the second adsorption layer 61 perpendicular to the flow direction F4 is larger than the sectional area of the first adsorption layer 11 perpendicular to the flow direction E.

Figure 8:
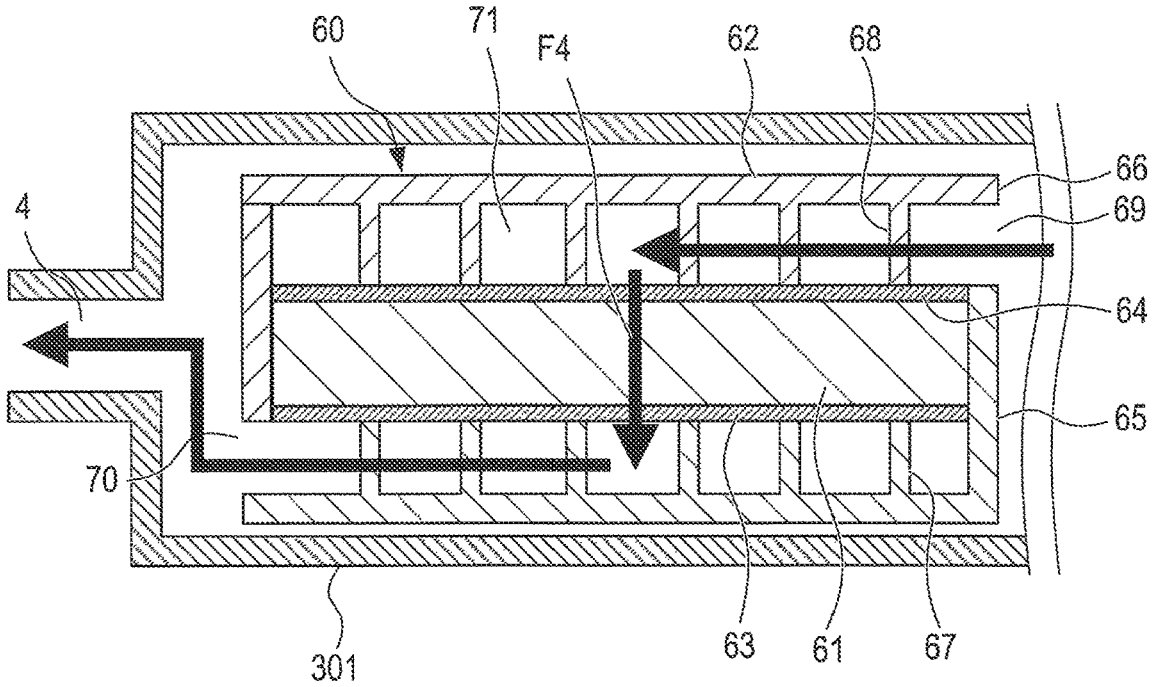
FIG. 8 is a schematic sectional view of a second adsorption chamber and therearound in the evaporated fuel treatment device according to the fourth embodiment.

As shown in FIG. 8, the second adsorption chamber 60 comprises the second adsorption layer 61, the inner case 62, and two partition members 63 and 64.

The inner case 62 comprises a case body 65, a lid 66, a case-side support 67, and a lid-side support 68. The lid 66 is configured to close an opening of the case body 65. The case body 65 and the lid 66 are welded together.

In the case body 65, a slit 69 open toward the first adsorption chamber 10 is arranged in a side closer to the first adsorption chamber 10. The slit 69 has a shape extending in a depth direction of FIG. 8 (i.e., in a direction from the front side to the back side of the sheet of FIG. 8.

In the case body 65, a slit 70 open toward the atmosphere port 4 is arranged in a side closer to the atmosphere port 4. Similarly to the slit 69, the slit 70 has a shape extending in the depth direction of FIG. 8.

The case-side support 67 is provided to stand upright from a bottom surface of the second adsorption chamber 60 when the side where the lid 66 is arranged is viewed as an upper side, and supports the second adsorption layer 61 via the partition member 63. The lid-side support 68 is provided to stand upright from the lid 66, and supports the second adsorption layer 61 via the partition member 64.

The second adsorption chamber 60 includes therein a space 71 arranged between the first adsorption layer 11 and the second adsorption layer 61 in the flow passage.

[4-2. Effects]

The fourth embodiment as detailed above produces effects similar to the effect (1a) of the first embodiment and to the effects of the second embodiment.

In addition, the fourth embodiment makes it easier to diversely manufacture the evaporated fuel treatment device 300 based on a different specification without changing the design of the outer case 301 by appropriately manufacturing and mounting the inner case 62 forming the second adsorption chamber 60 having a different volume, etc.

5. Other Embodiments

Although the embodiments of the present disclosure have been described so far, the present disclosure is not limited to the above-described embodiments and can be implemented in various forms.

Figure 9:
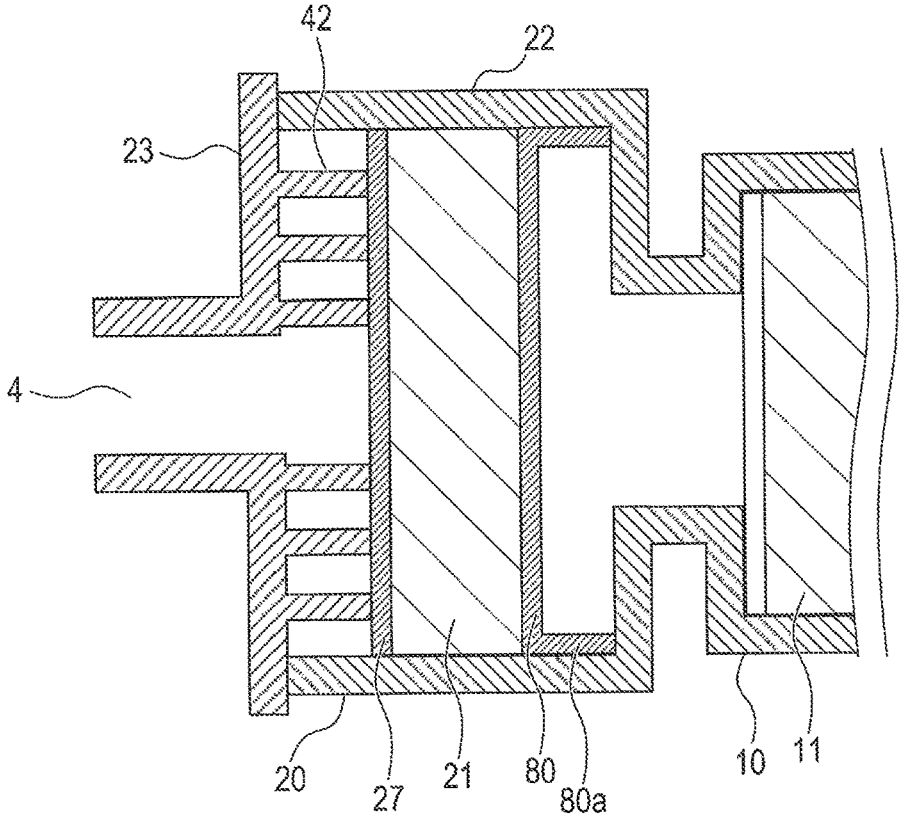
FIG. 9 is a view showing a case where a partition member on a bottom side has a different shape.
Figure 10:
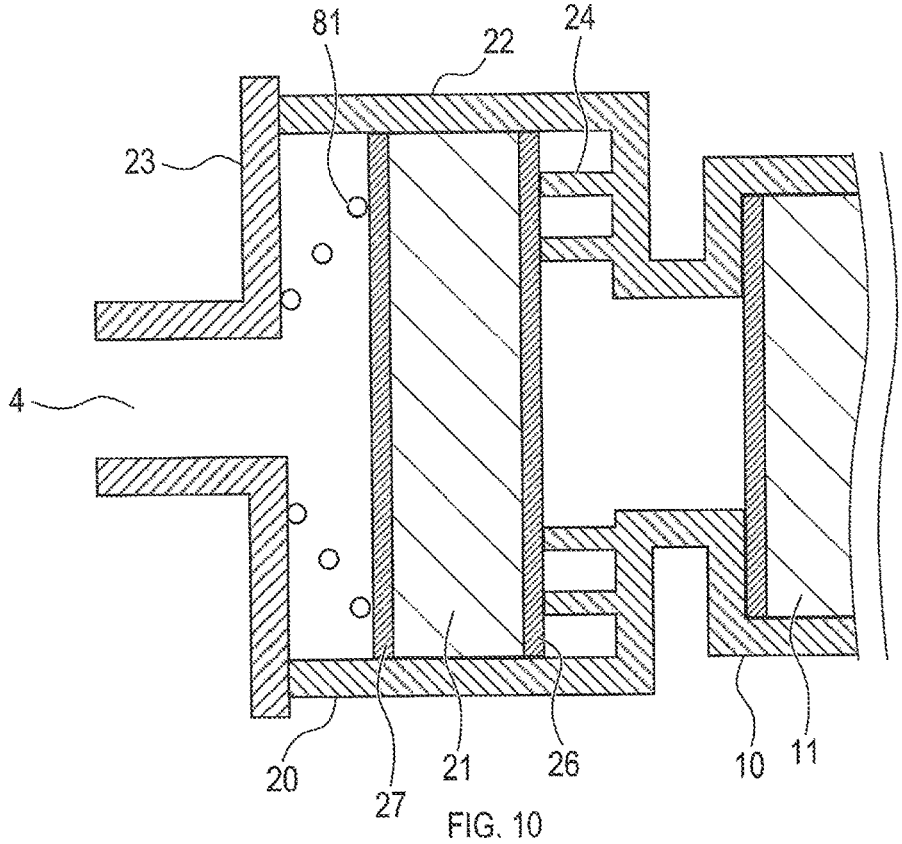
FIG. 10 is a view showing a case where a partition member on a lid side includes a spring.

(5a) The method for supporting the second adsorption layer in the second adsorption chamber is not limited to that in the above-described embodiments. For example, as shown in FIG. 9, the second adsorption layer may be supported by a partition member 80 having a leg 80*a*, instead of the case-side support 24 in the first embodiment. Further, as shown in FIG. 10, the second adsorption layer may be supported by a spring 81, instead of the lid-side support 25 in the first embodiment. These also apply to the second to fourth embodiments.

(5b) In the above-described second and third embodiments, the direction in which the evaporated fuel flows through the second adsorption layer is substantially perpendicular to the direction in which the evaporated fuel flows through the first adsorption layer. However, an angle at which the direction in which the evaporated fuel flows through the second adsorption layer intersects with the direction in which the evaporated fuel flows through the first adsorption layer is not limited to this. For example, the angle may be 15°, 45°, or another angle.

(5c) The shape of the second adsorption layer is not limited to the rectangular parallelepiped shape as illustrated in the above-described embodiments. For example, the shape of the second adsorption layer may be a circular cylindrical shape, a polygonal columnar shape, or another shape. In addition, the shape of the second adsorption chamber itself is also not limited in particular, and may be a rectangular parallelepiped shape, a circular cylindrical shape, a polygonal columnar shape, or another shape.

(5d) One or more functions of a single element in the above-described embodiments may be performed by two or more elements, and one or more functions of two or more elements may be performed by a single element. Part of a configuration in the above-described embodiments may be omitted. At least part of a configuration in the above-described embodiments may be added to or replace another configuration in the above-described embodiments.

What is claimed is:

1. An evaporated fuel treatment device configured to adsorb and desorb an evaporated fuel originating in a fuel tank, the evaporated fuel treatment device comprising:

a charge port configured to take in the evaporated fuel and a purge port configured to discharge the evaporated fuel, each of the charge port and the purge port being arranged at an end of a flow passage through which the evaporated fuel passes;

an atmosphere port arranged at an end opposite to the end of the flow passage where the charge port and the purge port are arranged, the atmosphere port being open to an atmosphere;

a first adsorption chamber arranged along the flow passage;

a second adsorption chamber connected to the first adsorption chamber, the second adsorption chamber being arranged, along the flow passage, closer to the atmosphere port with respect to the first adsorption chamber;

a first adsorption layer configured to adsorb the evaporated fuel, the first adsorption layer being arranged within the first adsorption chamber; and a second adsorption layer configured to adsorb the evaporated fuel, the second adsorption layer being arranged within the second adsorption chamber, wherein a sectional area of the second adsorption layer perpendicular to a direction in which the evaporated fuel flows through the second adsorption layer is larger than a sectional area of the first adsorption layer perpendicular to a direction in which the evaporated fuel flows through the first adsorption layer, and wherein the direction in which the evaporated fuel flows through the second adsorption layer intersects with the direction in which the evaporated fuel flows through the first adsorption layer.

2. The evaporated fuel treatment device according to claim 1, wherein the second adsorption chamber includes therein a space arranged between the first adsorption layer and the second adsorption layer in the flow passage.

3. The evaporated fuel treatment device according to claim 2, wherein the space is located on a lower side within the second adsorption chamber in a state in which the evaporated fuel treatment device is mounted in a vehicle.

4. An evaporated fuel treatment device configured to adsorb and desorb an evaporated fuel originating in a fuel tank, the evaporated fuel treatment device comprising:

a charge port configured to take in the evaporated fuel and a purge port configured to discharge the evaporated fuel, each of the charge port and the purge port being arranged at an end of a flow passage through which the evaporated fuel passes;

an atmosphere port arranged at an end opposite to the end of the flow passage where the charge port and the purge port are arranged, the atmosphere port being open to an atmosphere;

a first adsorption chamber arranged along the flow passage;

a second adsorption chamber connected to the first adsorption chamber, the second adsorption chamber being arranged, along the flow passage, closer to the atmosphere port with respect to the first adsorption chamber;

a first adsorption layer configured to adsorb the evaporated fuel, the first adsorption layer being arranged within the first adsorption chamber; and a second adsorption layer configured to adsorb the evaporated fuel, the second adsorption layer being arranged within the second adsorption chamber, wherein the first adsorption chamber and the second adsorption chamber are arranged serially along an inflow direction of the evaporated fuel flowing into the first adsorption chamber, and wherein a sectional area of the second adsorption layer perpendicular to a direction in which the evaporated fuel flows through the second adsorption layer is larger than a sectional area of the first adsorption layer perpendicular to a direction in which the evaporated fuel flows through the first adsorption layer.

5. An evaporated fuel treatment device configured to adsorb and desorb an evaporated fuel originating in a fuel tank, the evaporated fuel treatment device comprising:

a charge port configured to take in the evaporated fuel and a purge port configured to discharge the evaporated fuel, each of the charge port and the purge port being arranged at an end of a flow passage through which the evaporated fuel passes;

an atmosphere port arranged at an end opposite to the end of the flow passage where the charge port and the purge port are arranged, the atmosphere port being open to an atmosphere;

a first adsorption chamber arranged along the flow passage;

a second adsorption chamber connected to the first adsorption chamber, the second adsorption chamber being arranged, along the flow passage, closer to the atmosphere port with respect to the first adsorption chamber;

a first adsorption layer configured to adsorb the evaporated fuel, the first adsorption layer being arranged within the first adsorption chamber;

a second adsorption layer configured to adsorb the evaporated fuel, the second adsorption layer being arranged within the second adsorption chamber;

an outer case forming an outer frame of the evaporated fuel treatment device; and an inner case mounted inside the outer case and forming a second adsorption chamber, wherein a sectional area of the second adsorption layer perpendicular to a direction in which the evaporated fuel flows through the second adsorption layer is larger than a sectional area of the first adsorption layer perpendicular to a direction in which the evaporated fuel flows through the first adsorption layer.

6. The evaporated fuel treatment device according to claim 5, wherein a part of the outer case forms the first adsorption chamber.

* * * * *